US005413442A

United States Patent [19]

Grey

[11] Patent Number: 5,413,442

[45] Date of Patent: May 9, 1995

[54] BOLT-NUT ASSEMBLY FOR RAILROAD CROSSING FROGS

[75] Inventor: John J. Grey, Berea, Ohio

[73] Assignee: Barnes Group, Inc., Bristol, Conn.

[21] Appl. No.: 124,708

[22] Filed: Sep. 21, 1993

[51] Int. Cl.[6] ..... F16B 25/00; F16B 35/00; F16B 35/04; E01B 11/00

[52] U.S. Cl. ..... 411/366; 411/287; 411/386; 411/424; 411/903; 238/262

[58] Field of Search ..... 411/3-5, 411/88, 87, 287, 411, 424, 903, 386; 238/262, 342, 377

[56] References Cited

U.S. PATENT DOCUMENTS

| | | | |
|---|---|---|---|
| 168,483 | 10/1875 | Hamilton | 411/88 |
| 1,105,697 | 8/1914 | Reynolds | 238/262 |
| 2,985,898 | 5/1961 | Goude | 411/397 X |
| 3,208,494 | 9/1965 | Skidmore | 411/287 X |
| 3,812,757 | 5/1974 | Reiland | 411/5 |
| 4,360,154 | 11/1982 | Collins | 238/262 |
| 4,735,537 | 4/1988 | Rath | 411/411 |
| 4,837,090 | 6/1989 | Hyner et al. | 411/903 X |

FOREIGN PATENT DOCUMENTS

| | | | |
|---|---|---|---|
| 1273146 | 5/1972 | United Kingdom | 411/287 |

OTHER PUBLICATIONS

"Maintenance of Way Fasteners Solutions", pp. III-5 to III-6, III-9, VI-7 to VI-10, Camcar Textron.

*Primary Examiner*—Neill R. Wilson
*Attorney, Agent, or Firm*—Vickers, Daniels & Young

[57] ABSTRACT

An improved railroad frog bolt-nut assembly is disclosed. The bolt has a square head and a shank. The shank has an unthreaded portion adjacent the head and a threaded portion at its terminal end. The threaded portion is rolled to a diameter equal to the shank's unthreaded portion to produce high fastener strength. A unitary lock nut is formed with an annular boss extending from it's outside end in which indentations intersecting with some of the nut threads are pressed to provide an interference, locking fit with the bolt threads.

14 Claims, 4 Drawing Sheets

BOLT-NUT ASSEMBLY FOR RAILROAD CROSSING FROGS

This invention relates generally to railroad track joints and more particularly, to a fastener for use in splicing rails with railroad crossing frogs, switches and turnouts.

BACKGROUND

Within the railroad industry, railroad switches, crossing frogs, turnouts and the like are spliced to the rail by inserting massive, threaded fasteners through a series of aligned, longitudinally space holes numbering as high as 20 which extend through the rail web and frog, i.e., the rail joint.

As a general rule, all railroad equipment must be designed to interchange with existing track and rolling stock. As the weight of the train, as exemplified by unit trains, as well as the weight of the car continues to increase, the load and service demands placed on crossings, switches, turnouts, etc. have also increased. Specifically, while the rail itself will flex and is designed to flex, the switch must be secured to or spliced into the rail in a rigid, non-yieldable, but removable manner. Because the rail profile is fixed as is, to some extent, the configuration of the switch, the rail joint can only be strengthened to account for the increased service load by increasing the strength and number of fasteners for the rail joint. As the hole number increases, the on site installation of the switches in which hole alignment is achieved by spud wrenches and the like becomes increasingly difficult. Shank tolerance on the bolt becomes more critical. It should be appreciated that bolt diameters range anywhere from 1 to about 1⅜" and shank length extends anywhere from 8" to 30". Sledging 20 such bolts through 20 holes aligned in a track bed with a spud is progressively difficult. Conventional, forged bolts have varying tolerances and aggravate the installation problem. Further, the threaded bolt end is simply chamfered at its outer edge. Even though the bolts are now heat treated to have a high tensile strength, sledging the last bolts through the aligned holes can mar or distort the threads. This, in turn, makes application of the nuts difficult, especially so if standard, conventional, hand operated wrenches are used such as when one switch is to be removed and replaced as contrasted to laying a new section of track in which impact-air wrenches may be available.

Until now, the only improvement made by the railroad supply industry to the increased load demands placed on rail joints has been to increase the strength of the bolt by changing its chemistry to obtain improved physical properties. The bolt remains in it's "as forged" condition with widely varying tolerances on the shank and thus on the thread which is typically a cut thread. As is well known in the fastener art, the strength of a bolted connection can only be achieved if the bolt and nut threads are appropriately prestressed by application of a uniform bearing force exerted by the bolt head and nut. If the bolt head is not perpendicular with the bolt shank, a uniform stress cannot be imparted circumferentially to the threads resulting in a weaker connection than what is otherwise possible. For this reason, washers are typically spaced by the AAR which, to some extent, may alleviate the problem.

Finally, the nut must, of course, be removably locked to the thread after the fastener has been appropriately torqued to it's prestressed, applied condition. The discussion concerns relatively large, standard sized, square nuts and bolt heads having side dimensions of about 2". Locking techniques conventionally used for small fasteners, such as a thread deformable plastic collar, are not applicable to a rail-switch splice application. Typically, a lock nut is supplied of two metal pieces with the second metal piece locked into the first metal piece and having an interference thread fit for locking purposes. The problem is simply that the insert becomes separated from the locked body for any number of reasons and the fastened connection loosens.

In general summary, the prior art has "improved" the forged bolt-nut assembly by making the nut a two-piece lock nut which has proved unacceptable and by simply upgrading the heat treatment and chemical properties of the bolt and nut to increase the physical properties of the fastener, specifically it's yield or tensile strength. As briefly noted above, the threaded end portion of the bolt shank has threads cut thereon so that the outside diameter of the thread is maintained at the same diameter as the unthreaded portion of the bolt shank adjacent the bolt head. Because it is well known that cut threads are not as strong as rolled threads, one manufacturer supplies a bolt with a rolled thread at it's terminal end, which, incidentally, is also supplied with a special torque breakaway appendage extending from the bolt head for application. When the threads are rolled onto the terminal end of the bolt blank, the outside diameter of the bolt shank increases to the specified bolt diameter, (i e , 1", 1⅛", or 1⅜"), However, the unthreaded portion of the holt shank adjacent the bolt head remains at it's smaller pre-rolled blank diameter. Thus, the unthreaded shank portion of the bolt doesn't occupy the bolt opening through which it extends to the extent it should and produces a fundamentally inferior connection, resulting in looseness of the rail joint as well as a reduction in shear strength of the fastener.

SUMMARY OF THE INVENTION

Accordingly, it is a principal object of the present invention to provide a railroad frog bolt-nut assembly which provides a stronger connection than that of the prior art in a fastener assembly that is better suited for railroad application than conventional prior art fasteners.

This object along with other features of the invention is achieved in a conventional railroad frog crossing bolt and nut assembly for clamping railroad rail sections together. The conventional assembly includes an elongated, cylindrical body or shank with a given diameter of at least about 1.0" and a length of at least about 8.0". The cylindrical body has an integral square head having an orthogonal bearing surface, an unthreaded body portion adjacent the head, and a terminal threaded portion with the threads of the threaded portion having a diameter not greater than the given diameter. The assembly also includes a square lock nut adapted to be threaded onto the threaded portion after the cylindrical body has been passed through at least two of the rail sections. The improvement of the invention includes forming the threads of the elongated body by a rolling action to provide increased physical strength while maintaining the outside diameter of the thread at the given diameter with the unthreaded portion of the bolt shank also maintained at the same given diameter and the body and orthogonal bearing surfaces being machined to a preselected mechanical tolerance so that the bearing surface and the body are mutually perpendicular. Thus, the fastener's threads are uniformly stressed while providing that the shank dimensionally occupies the openings in the railroad frog crossing to assure not only accurate railroad frog crossing alignment or assembly but also a stronger connection.

In accordance with another feature of the invention, the nut includes an internal, continuous thread and a plurality of mechanically deformed indentations on the nut intersecting the threads whereby the threads are deformed to provide an interference fit when the nut is screwed onto the bolt's threaded portions. Thus, a unitary lock nut is provided in which the interference locking fit can be easily achieved to avoid the disassembly problems associated with the integral two-piece prior art lock nuts. In accordance with specific aspects of this feature of the invention, at least diametrically opposed, mechanically formed indentation are provided at the rear end of the nut with each indentation having a depth sufficient to deform at least two of the continuous threads of the nut.

In accordance with still another feature of the invention, the bolt shank has a tapering frusto-conical end which tapers inwardly at an angle of about 14°–16° relative to the longitudinal centerline of the bolt for a distance of about ½" whereby the bolt has an unthreaded forward, guiding edge permitting alignment of the rail sections while minimizing distortion of the threads which could otherwise occur when the bolts are sledged or otherwise impacted into the frog or joint openings.

In accordance with still yet another aspect of the invention, a railroad frog, switch and turnout bolt-nut assembly is provided which includes, in combination, a bolt having a square head and shank with the head having a machined underside surface to assure perpendicularity with the shank. The shank has a machine unthreaded portion adjacent the head of a given diameter anywhere between about 1" to about 1⅜" which is maintained within a tolerance of about 0.012". The shank also has a rolled, threaded portion adjacent the unrolled portion having teeth with an outside diameter equal to the diameter of the unthreaded portion and a tapering end portion adjacent the threaded portion with the shank having a length anywhere between about 8" to about 30". A square unitary lock nut is provided having a machined flat annular base surface extending from one end thereof and mechanically formed indentations on the opposite end. The nut has an internal continuous thread formed therein extending from one end to its opposite end and the indentations interfere with the threads on the opposite end Whereby the threads are deformed to provide an interference fit with the bolt threads when the nut is screwed onto the threaded portion of the bolt shank.

It is thus an object of the invention to provide a railroad frog bolt-nut assembly in which the threaded connection has improved strength.

It is yet another object of the invention to provide railroad frog bolt-nut assembly in which certain surfaces are maintained within close tolerances to assure that the assembled fastener uniformly stresses the threads to achieve the maximum strength of the threaded connection.

It is yet another object of the invention to provide a railroad frog bolt-nut assembly which can be easily applied to railroad frog crossings, turnouts, switches and the like to make their on site installation easier.

It is yet still a further object of the invention to provide a railroad frog bolt-nut assembly which assures proper alignment of the railroad frog crossing in a connection uniformly occupying the space provided in the railroad frog bolt openings resulting in a long lasting, durable, rigid connection.

A still further object of the invention is to provide in a railroad frog bolt-nut assembly, a relatively inexpensive unitary lock-nut which can be reused.

A still further object of the invention is to provide a railroad frog bolt-nut assembly having any one or more or any combination thereof of the following objects:

a. easy application assured by long taper;
b. high strength threads achieved by thread rolling;
c. accurate frog or joint alignment achieved by dimensioning the bolt on threaded shank portions to have the same diameter as the outside diameter of the rolled threads;
d. unitary lock nut insuring long lasting connection;
e. machined bolt head and nut engaging surface to ensure perpendicularity with bolt shank resulting in uniform stressing of the threaded connection to achieve maximum pre-stress torque.

These and other objects of the invention will become apparent to those skilled in the art upon reading the Detailed Description of the Invention set forth below taken in conjunction with the drawings which will be described in the next section.

BRIEF DESCRIPTION OF THE DRAWINGS

The invention may take physical form in certain parts and arrangement of parts, a preferred embodiment of which will be described in detail herein and illustrated in the accompanying drawings which a form a part hereof and wherein.

DETAILED DESCRIPTION OF THE INVENTION

Figure 1:
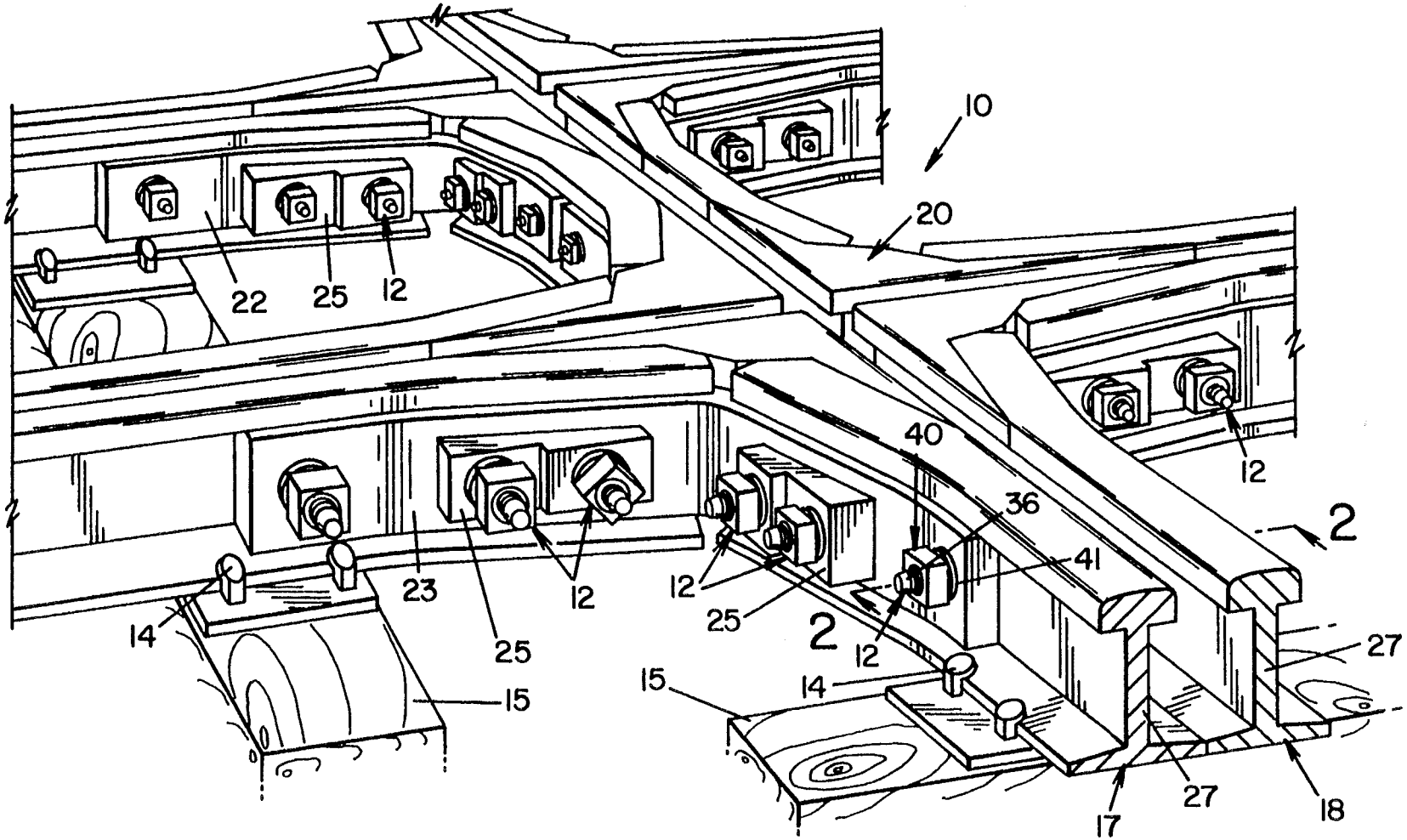
FIG. 1 is a perspective view of a railroad frog crossing utilizing the railroad frog bolt-nut assembly of the present invention.

Referring now to the drawings wherein the showings are for the purpose of illustrating a preferred embodiment of the invention only and not for the purpose of limiting same, there is shown in FIG. 1 a conventional railroad frog crossing 10 which is assembled by means of a plurality of railroad frog bolt-nut assemblies 12 of the present invention with railroad frog crossing 10 secured by spikes 14 to railroad ties 15 in a conventional manner. Railroad frog crossing 10 is illustrative of the types of crossings, switches and turnouts in which bolt-nut assemblies 12 of the present invention are used. All rail joining items such as crossings, switches and turnouts have been standardized by the American Association of Railroads (AAR). That is, each component making up any type of specified railroad frog crossing, for example, is dimensionally specified by the AAR down to the bolt hole size, opening and spacing. Conceptually, all crossings, switches and turnouts join two rail sections 17, 18 together by means of preformed channels, spacers, plates, etc. which are fastened together by means of a plurality of bolt-nut assemblies 12 which rigidly secure first and second rail sections 17, 18 to one another in a predetermined spaced relationship. In FIG. 1 a railroad frog 20 is spliced between first and second rail sections 17, 18 which in turn are clamped between inner and outer web fitting brackets 22, 23. The clamping is, of course, accomplished by bolt-nut assemblies 12, which, depending upon the configuration of railroad frog crossing 10, may use wedges 25 to maintain uniform bearing surfaces under bolt head and nut. Again, railroad frog crossing 10 is shown as a typical example of the environment in which bolt-nut assemblies 12 are applied and the term railroad "frog" as used herein is to be interpreted to cover all such railroad crossings, switches and turnouts. What is to be understood is that rail sections 17, 18 are joined by an opening 26 formed in the mid-point of their web section 27 through which bolt-nut assembly 12 passes and that there are a plurality of such rail openings 26 extending along the length of rail sections 17, 18 by which railroad frog 20 is secured and by which rail sections 17, 18 are bent or secured in their bent or shaped form as illustrated. In FIG. 1, the plurality of rail openings 26 for each rail section 17, 18 are shown as simply comprising three in number. However, those skilled in the art readily understand that there are installations requiring the insertion of as many as twenty bolt-nut assemblies 12 for each rail section 17, 18 joined or spliced together. It will be, of course, appreciated that the alignment of all of the rail openings 26 with all of the inter-fitting components becomes increasingly difficult as bolt-nut assemblies 12 are progressively inserted given the tolerances between the bolt shank and the openings.

Figure 2:
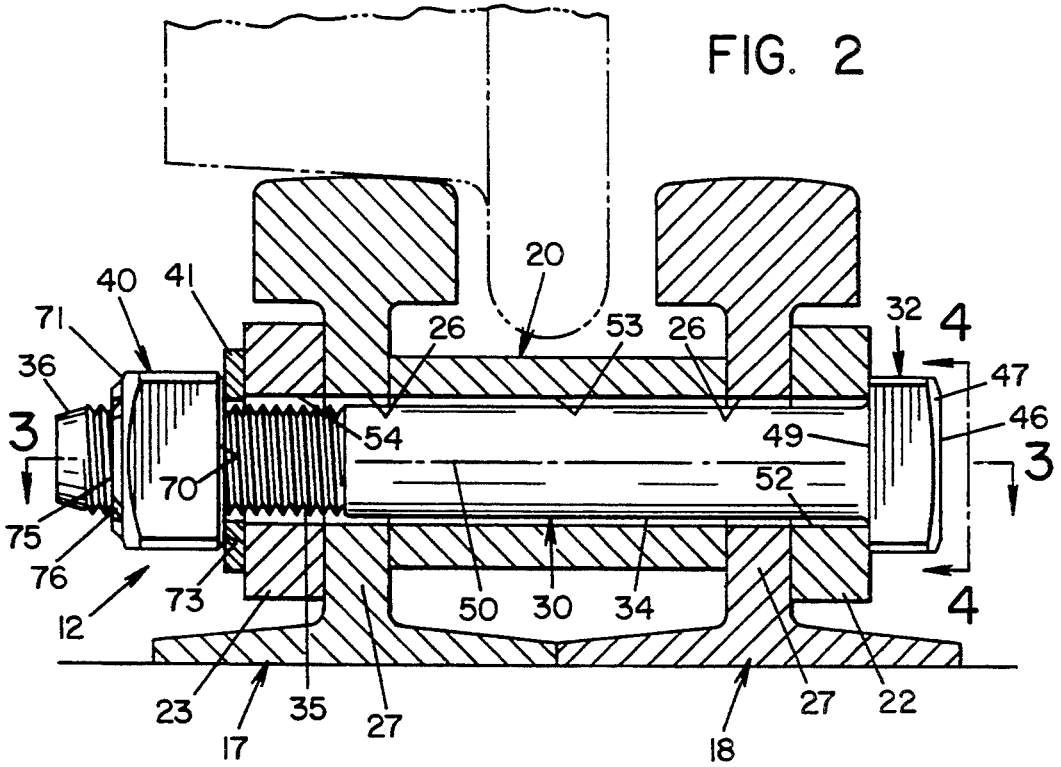
FIG. 2 is a sectioned elevation view of the railroad frog bolt-nut assembly of the present invention applied to the railroad frog crossing taken along lines 2—2 of FIG. 1.
Figure 4:
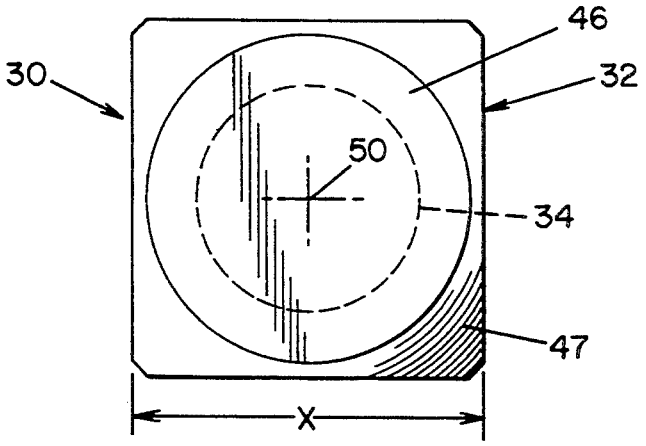
FIG. 4 is an end view of the bolt head of the present invention taken along lines 4—4 of FIG. 2.

Referring now to FIG. 2 there is shown in cross section one of the joint sections of railroad frog crossing 10. The bolt-nut assembly 12 includes a bolt 30 having a square head 32 from which extends an elongated body or shank having an unthreaded shank portion 34 extending from square head 32 and terminating at a threaded shank portion 35 which in turn terminates at a tapering forward end portion 36. A unitary lock nut 40 completes the general description of bolt-nut assembly 12 which also, typically, includes a flat washer 41.

Bolt 30 is formed as a forging from AISI 4140 carbon steel heat treated to have a minimal tensile strength of 150,000 psi with a Rockwell core hardness of HRC 33-39 and a Rockwell surface hardness of HR 30-N (HRC 58.6 max). A conventional quench heat treat process including decarburization control is used to harden bolt 30. Bolts 30 are supplied, typically, in diameters of no less than 1" and, typically, in diameters of 1", $1\frac{1}{8}$" and $1\frac{3}{8}$". The $1\frac{3}{8}$" size is discussed in this specification, it being understood that the same tolerances, etc. apply to the other sizes. The total length of the bolt shank is supplied in $\frac{1}{2}$" increments from 8" to $29\frac{1}{2}$" in length. The distance of the full threaded shank portion 35 is constant at $4\frac{1}{4}$". The thread for the preferred embodiment is specified as $1\frac{3}{8}$"–6 UNRC 2A. Unitary lock nut 40 is formed from 1045 plain carbon steel heat treated to a Rockwell hardness of 26–32 HRC with a proof load of 150,000 psi. The lock nut threads 43 are tapped after heat treatment and are specified for the preferred embodiment as $1\frac{3}{8}$"–6 UNCS 2B threads. The minor diameter has a maximum dimension of 1.2250" and a minimum dimension of 1.2100". The pitch diameter has a maximum dimension of 1.2771"and a minimum dimension of 1.2719". Washer 41 is somewhat conventional and is formed of 1050–1060 medium carbon steel which is quenched and tempered to Rockwell 38 to 42 HRC. Washers 41 are tumbled to remove oxides and burrs.

Referring now to FIGS. 2–5, both bolt head 32 and lock nut 40 are formed as squares with a standard side dimension "X" which is about 2.1" so that standard track wrenches or standard impact drive track sockets can be used to install bolt-nut assembly 12.

Bolt head 32 has an outside end surface 46 which is bevelled as at 47 and an underside surface 49 which importantly is machined flat and perpendicular to bolt longitudinal center line 50. By machining underside surface 49, bolt head 32 is assured of uniformly engaging inner web fitting bracket 22 so that when nut 40 is tightened the threads of the connection can be circumferentially stressed in a uniform manner.

Similarly, unthreaded shank portion 34 is also uniformly machined to the bolt diameter. In the preferred embodiment, machining unthreaded shank portion 34 maintains bolt diameter between a maximum of 1.375" and a minimum of 1.363". The tolerance of 0.012" is maintained for other bolt sizes. The importance of maintaining unthreaded shank portion 34 at the same diameter as the bolt diameter should be apparent from FIG. 2 in that unthreaded shank portion 34 must also pass through an opening 52 in an inner web fitting bracket 22, opening 26 in second rail section 18 and an opening 53 in railroad frog 20 while threaded shank portion 35 passes through an opening 54 in outer web fitting bracket 23 and partially through opening 26 in first rail section 17. By maintaining the bolt diameter for unthreaded shank portion 34, the clearance within openings 26, 52 and 53 is taken up or minimized providing better alignment of the components of railroad frog crossing 10 and increasing the mass of bolt-nut assembly to make it better able to resist any shearing forces imparted to the bolt 30 by the components of railroad frog crossing 10. Also, the perpendicularity between unthreaded shank portion 34 and underside surface 49 can be better assured when unthreaded shank portion 34 is machined in a properly designed fixture period. In the prior art fastener discussed above, which used roll threads, the diameter of the unthreaded shank was equal to the shank's blank diameter. Thus, only the threaded portion of the prior art was properly dimensioned to the bolt diameter. This increased the "slop" in the hole connection and resulted in a weaker bolt than that of the present invention because it's shear strength was reduced.

Figure 6:
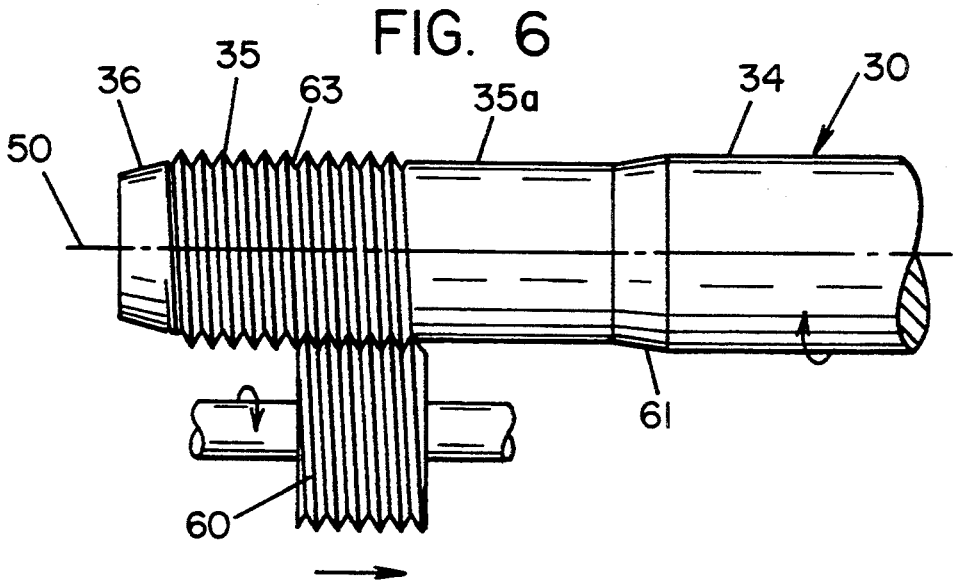
FIG. 6 is a longitudinal view showing threads being rolled onto the shank blank of the bolt.

As discussed above, it is a specific feature of the present invention to form the threads on threaded shank portion 35 by rolling. As is well known, rolled threads have advantages over cut threads which include, among other things, improved tensile, shear and fatigue strength; smooth surface finish, and the ability to maintain close accuracy. The rolling of the thread is generally illustrated in FIG. 6 in which a conventional die 60 is rotated and longitudinally moved relative to the rotating shank of bolt 30. One cylindrical die is illustrated merely for convenience. Two or three cylindrical dies would actually be used and the die 60 could be stationary in which instance the bolt would move longitudinally or die 60 can move longitudinally as described. In FIG. 6, threaded shank portion 35 is partially shown and it's unthreaded or blank portion designated by reference numeral 35*a*. The diameter of thread blank 35*a* is predeterminately sized to be less than the diameter of unthreaded shank portion 34 and in fact, a frusto-conical, transition surface 61 is shown to illustrate this, When external threads 63 are formed by die(s) 60, their outside diameter will equal the diameter of unthreaded shank portion 34. In the preferred embodiment, the diameter of thread blank 35*a* has a reference diameter of 1.260". Because external thread 63 has an outside diameter equal to the bolt diameter, the same dimensional relationship within openings such as 26 and 54 is maintained for threaded shank portion 35 as is maintained for unthreaded shank portion 34.

Forward end portion 36 of bolt 30 is tapered radially-inwardly as a frusto-conical surface. The angle of the taper is set at about 14°–16° relative to longitudinal center line 50 and its distance is about ½", i.e., 0.486". This provides an appropriate alignment mechanism which protects external threads 63 from nicking or being marred when bolts 30 are sledged or otherwise forced through the openings 26, 52, 53 and 54. Surprisingly, all prior art bolts had insignificant chamfers at their terminal end making their application progressively difficult when a number of bolts 30 had to be applied to any particular section of railroad frog crossing 10.

Figure 3:
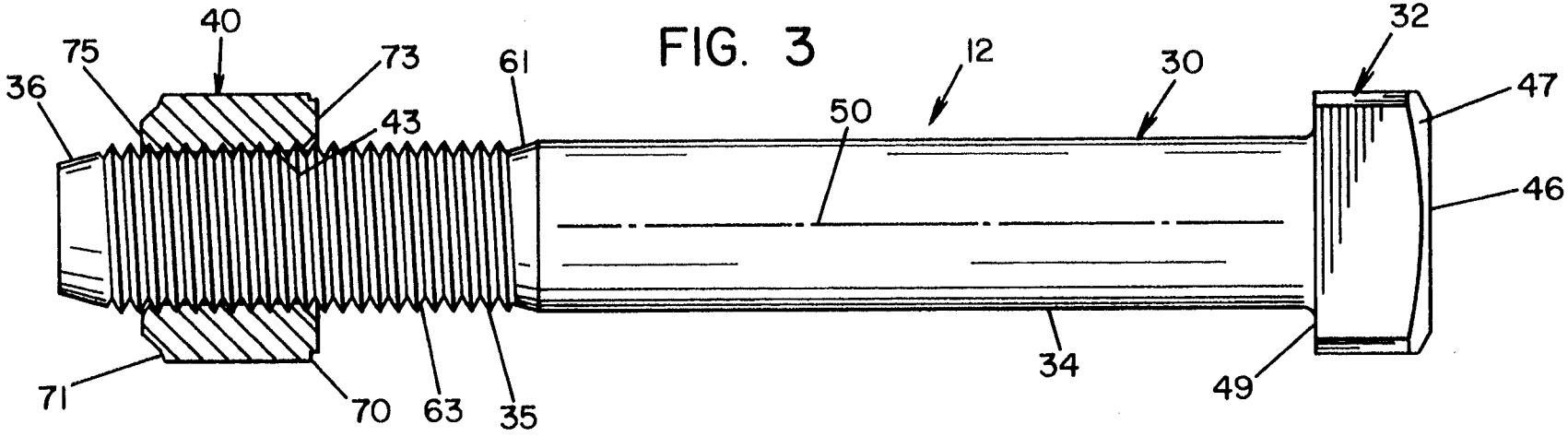
FIG. 3 is a longitudinal, partially sectioned view of the railroad frog bolt-nut assembly taken along lines 3—3 of FIG. 2.
Figure 5:
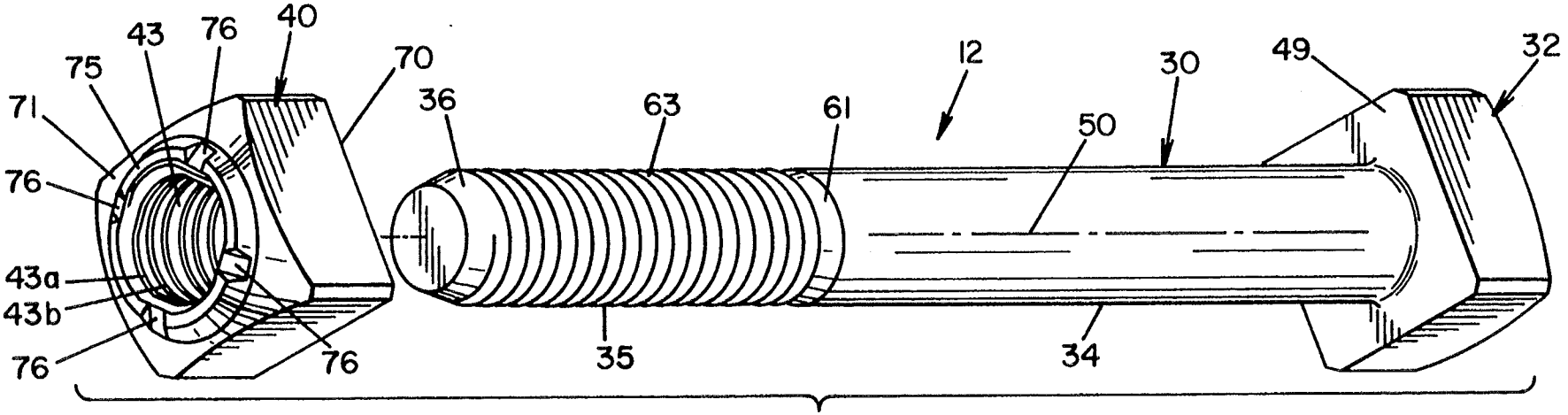
FIG. 5 is a perspective view of the bolt and nut.

Nut 40 has an inside end 70 and an outside end 71. A protruding machined annular base seating surface 73 is provided at inside end 70 to assure uniform engagement with flat washer 41. It should be appreciated that by machining bolt head underside surface 49, unthreaded shank portion 34 and annular seating base surface 73, bolt-nut assembly 12 can be properly tightened so that external threads 63 and internal locknut threads 43 are uniformly preloaded. As best shown in FIGS. 3 and 5, outside end 71 of nut 40 is formed with an annular boss 75 which extends to locknut threads 43. That is, in nut 40, the internal thread 43 extends and continues through annular boss 75. After nut 40 is heat treated and locknut threads 43 are formed, a mechanical indentation or deflection lobe 76 is hammered or pressed into annular boss 75. In the preferred embodiment, there are four such deflection lobes 76 circumferentially spaced at right angles to one another formed in annular boss 75. While four such deflector lobes 76 are preferred, it is believed that locknut 40 will function with two diametrically opposed deflection lobes 76. The indentations or deflector lobes 76 are hammered or pressed into outside end 71 a distance sufficient to deform at least the first two lock nut threads designated as 43*a*, 43*b* adjacent outside end 71. In practice, this distance in which the indentation or deflector lobes 76 extend into annular boss is about 0.100". Locknut threads 43*a*, 43*b* are deformed or distended generally in the shape of an ellipse by deflection lobes 76. The distended shape of lock nut threads 43*a*, 43*b* provides the interference fit with external threads 63 of threaded shank portion 35 of bolt 30 thus obviating the need for any two part prior art locknut and permitting the re-application of locknut 40 should it be necessary.

Finally, to minimize corrosion, bolt-nut assembly 12 is plated and then coated with a railblack finish which is baked onto the plating to protect against hydrogen embrittlement. Eventual corrosion releases white by-products of the plating readily seen against the railblack finish to signify bolt replacement. Nut 40 is supplied with a wax coating to reduce friction during installation.

The invention has been described with reference to a preferred embodiment. Obviously modifications and alterations will occur to others skilled in the art upon reading and understanding the invention. It is intended to include all such modifications and alterations insofar as they come within the scope of the present invention.

Having thus defined the invention, it is claimed:

1. In a railroad frog crossing bolt and nut assembly for clamping railroad rail sections together, said assembly including an elongated cylindrical shank body with a given diameter of at least about 1.0 inches and a length of at least about 8", an integral square head having an orthogonal bearing surface, an unthreaded body portion adjacent said head and a terminal threaded portion with the threads of said threaded portion having a diameter not greater than said given diameter and a square lock nut adapted to be threaded onto said threaded portion after said cylindrical body has been passed through at least two of said rail sections, the improvement comprising:

forming said threads by a rolling action to provide increased physical strength while maintaining the outside diameter of said thread at said given diameter, said unthreaded portion also maintained at said given diameter and said body and orthogonal bearing surface being machined to a preselected mechanical tolerance with said surface and body being mutually perpendicular;

said nut includes an internal, continuous thread and a plurality of mechanically deformed indentations on said nut and intersecting said threads whereby said threads are deformed to provide an interference fit when said nut is screwed onto said threaded portion; and said bolt has a tapering frusco-conical forward end prior to rolling said thread, said forward and tapering inwardly at an angle of about 14° to 16° relative to said longitudinal centerline of said bolt for a distance of about one-half inch whereby said bolt has an unthreaded forward guide edge permitting alignment of said rail sections to minimize distorting the threads on said threaded portion.

2. The improvement of claim 1 wherein said nut has a protruding mechanical annular bearing surface on its end which is opposite said mechanically deformed indentation for improved bearing against the flange of a rail section.

3. The improvement of claim 2 wherein the length of said bolt from its head varies anywhere from 8" to 30".

4. The improvement of claim 3 wherein said bolt head and said nut are sized square to permit application with conventional standard track bolt wrenches.

5. The improvement of claim 1 wherein said mechanically formed indentations comprise at least two indentations formed in the rear end of said nut diametrically spaced from another.

6. The improvement of claim 5 wherein said mechanically formed indentations at said rearward end of said nut extend into said nut a distance sufficient to distort two threads of said nut.

7. The improvement of claim 6 wherein said bolt and said nut has a black coating baked on a corrosion resistant plating applied to said bolt and said nut.

8. A railroad frog, switch and turnout bolt and nut assembly comprising in combination:

a bolt having a square head and a shank, said head having a machined underside surface perpendicular to said shank, said shank having a machined, unthreaded portion adjacent said head of a given diameter between 1" to about $1\frac{3}{8}$" within a tolerance of about 0.012", a rolled threaded portion adjacent said-unrolled portion with teeth having an outside diameter about equal the diameter of said unthreaded portion, and a tapering end portion adjacent said threaded portion, said shank having a length anywhere between about 1" to about 30"; and a square unitary lock nut having a machined, flat annular base surface extending from one end thereof and mechanically formed indentations on the opposite end, said nut having an internal, continuous thread formed therein extending from one end to its opposite end and said indentations intersecting said threads in said opposite end whereby said threads are deformed to provide an interference fit when said nut is screwed onto said threaded portion of said shank.

9. The assembly of claim 8 wherein said mechanically formed indentations comprise at least two indentations formed in the rear end of said nut diametrically spaced from another.

10. The assembly of claim 9 wherein said mechanically formed indentations at said rearward end of said nut extend into said nut a distance sufficient to distort two threads of said nut.

11. The assembly of claim 10 wherein said mechanically formed indentations at said rearward end of said nut are four in number spaced 90° apart from one another.

12. The assembly of claim 8 wherein said bolt has a tapering frusto-conical forward end prior to rolling said thread, said forward end tapering inwardly at an angle of about 14° to 16° relative to said longitudinal centerline of said bolt for a distance of about one-half inch whereby said bolt has an unthreaded forward guide edge permitting alignment of said rail sections without distorting the threads on said bolt.

13. The assembly of claim 8 wherein said bolt head and said nut are sized square to permit application with conventional standard track bolt wrenches.

14. The assembly of claim 8 wherein said bolt and said nut has a black coating baked on a corrosion resistant plating applied to said bolt and said nut.

* * * * *